US010422516B1

(12) United States Patent
Lee

(10) Patent No.: US 10,422,516 B1
(45) Date of Patent: Sep. 24, 2019

(54) LAMP STRUCTURE

(71) Applicant: Hui-Lun Lee, New Taipei (TW)

(72) Inventor: Hui-Lun Lee, New Taipei (TW)

( * ) Notice: Subject to any disclaimer, the term of this patent is extended or adjusted under 35 U.S.C. 154(b) by 0 days.

(21) Appl. No.: 16/106,834

(22) Filed: Aug. 21, 2018

(51) Int. Cl.

| | |
|---|---|
| ***F21V 21/34*** | (2006.01) |
| ***F21V 21/14*** | (2006.01) |
| ***F21V 17/10*** | (2006.01) |
| ***F21V 3/02*** | (2006.01) |
| ***F21V 23/00*** | (2015.01) |
| ***F21V 7/04*** | (2006.01) |
| ***F21V 17/12*** | (2006.01) |
| *F21S 6/00* | (2006.01) |
| *F21Y 103/33* | (2016.01) |
| *F21W 121/00* | (2006.01) |
| *F21Y 103/10* | (2016.01) |
| *F21Y 115/10* | (2016.01) |
| *F21V 21/096* | (2006.01) |
| *F21V 1/00* | (2006.01) |

(52) U.S. Cl.
CPC ..... *F21V 21/14* (2013.01); *F21V 3/02* (2013.01); *F21V 7/041* (2013.01); *F21V 17/105* (2013.01); *F21V 17/12* (2013.01); *F21V 21/34* (2013.01); *F21V 23/001* (2013.01); *F21S 6/002* (2013.01); *F21V 1/00* (2013.01); *F21V 21/096* (2013.01); *F21W 2121/00* (2013.01); *F21Y 2103/10* (2016.08); *F21Y 2103/33* (2016.08); *F21Y 2115/10* (2016.08)

(58) Field of Classification Search
CPC ..... F21V 1/00; F21V 21/34; F21V 21/096
See application file for complete search history.

(56) References Cited

U.S. PATENT DOCUMENTS

| | | | | |
|---|---|---|---|---|
| 5,061,872 | A * | 10/1991 | Kulka | B60Q 1/302 313/111 |
| 7,784,973 | B2 * | 8/2010 | Zhang | F21S 8/033 362/294 |
| 8,794,815 | B2 * | 8/2014 | Hsien | F21V 17/06 362/649 |
| 8,985,813 | B2 * | 3/2015 | Zaderej | F21S 2/005 362/249.02 |
| 2009/0021934 | A1 * | 1/2009 | Chu | F21S 11/00 362/241 |
| 2016/0061429 | A1 * | 3/2016 | Waalkes | F21V 23/001 362/217.15 |

* cited by examiner

*Primary Examiner* — Tho D Ta

(57) ABSTRACT

A lamp structure contains a lamp head and a magnetic seat. The lamp head includes a lampshade, a light transmission cover, and a light emitting element. The magnetic seat includes a holding member, at least one magnet, a first electrode plate, and a second electrode plate. The lampshade includes a first light exit, a second light exit, and a reflective face, wherein a gap is defined between the light transmission cover and the reflective face. The first electrode plate and the second electrode plate are electrically connected with the light emitting element via a wire, and the first and second electrode plates are made of metal material consisting of iron. The magnet magnetically attracts and produces magnetic force on the first and second electrode plates which magnetically attract on a conductive component consisting of iron by using the magnetic force so as to form a power circuit.

10 Claims, 10 Drawing Sheets

LAMP STRUCTURE

FIELD OF THE INVENTION

The present invention relates to a lamp structure.

BACKGROUND OF THE INVENTION

A conventional lamp is merely applied to illuminate lights, but it cannot obtain illumination, decoration, and direction adjustment totally.

The present invention has arisen to mitigate and/or obviate the afore-described disadvantages.

SUMMARY OF THE INVENTION

The primary objective of the present invention is to provide a lamp structure which contains at least one lamp head capable of being adjustably rotated to any direction.

Further objective of the present invention is to provide a lamp structure which contains the lampshade capable of producing backlights on a rear end of the lampshade so as to obtain decorative atmosphere.

Another objective of the present invention is to provide a lamp structure which contains a defensive structure configured to avoid magnetically attracting the first and second electrode plates on the first and second conductive rails wrongly.

To obtain above-mentioned objectives, a lamp structure provided by the present invention contains: a lamp head and a magnetic seat.

The lamp head includes a lampshade, a light transmission cover, and a light emitting element.

The magnetic seat includes a holding member, at least one magnet accommodated in the holding member, a first electrode plate, and a second electrode plate.

The lampshade is tubular and includes a first light exit and a second light exit which are defined on two ends of the lampshade respectively, and the lampshade is opaque and includes a reflective face formed on an inner wall thereof.

The light transmission cover is tubular and is accommodated in the lampshade, and a gap is defined between the light transmission cover and the reflective face.

The light emitting element is housed in the lampshades and is defined between the light transmission cover and the reflective face. Some of lights of the light emitting element penetrate through the light transmission cover, another of the lights of the light emitting element reflect from the reflective face of the lampshade to illuminate out the lamp head via a front side of the light transmission cover and the first light exit, and the other lights of the light emitting element emit to a rear side of the lampshade;

The first electrode plate and the second electrode plate are electrically connected with the light emitting element via a wire, and the first and second electrode plates are made of metal material consisting of iron, the magnet magnetically attracts and produces magnetic force on the first and second electrode plates, wherein and the first and second electrode plates magnetically attract on a conductive component consisting of iron by using the magnetic force so as to form a power circuit.

The lamp structure further contains a defensive structure, and the defensive structure includes a guide rail arranged on the body and includes a recess defined in the holding member of the magnetic seat. The guide rail is a protrusion extending along the body and deviates from a central axis of the body. For example, the guide rail is close to a peripheral side of the body proximate to the second conductive rail. Furthermore, the recess is engaged with the guide rail.

DETAILED DESCRIPTION OF THE PREFERRED EMBODIMENTS

Figure 1:
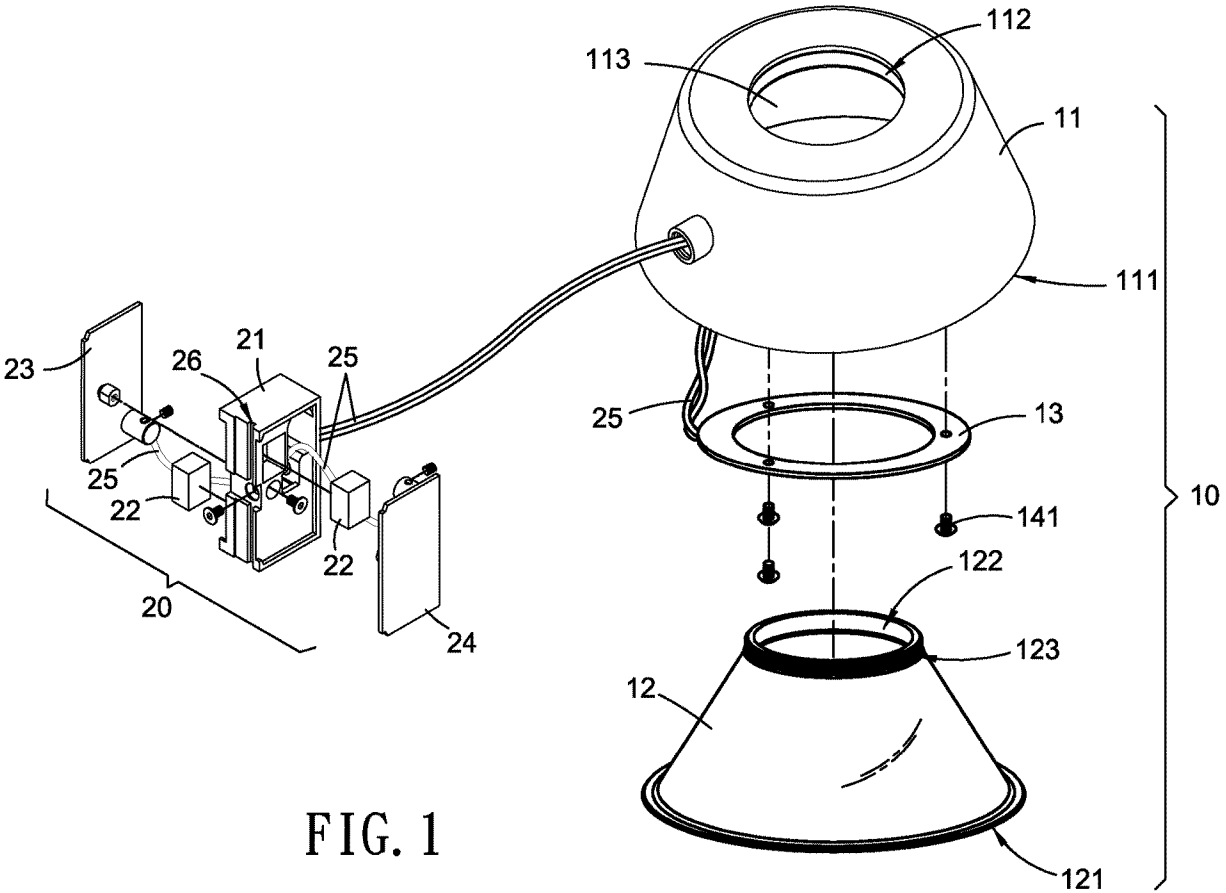
FIG. 1 is a perspective view showing the exploded components of a lamp structure according to a first embodiment of the present invention.

With reference to FIG. 1, a lamp structure according to a first embodiment of the present invention comprises: a lamp head 10 and a magnetic seat 20.

The lamp head 10 includes a lampshade 11, a light transmission cover 12, and a light emitting element 13.

Figure 2:
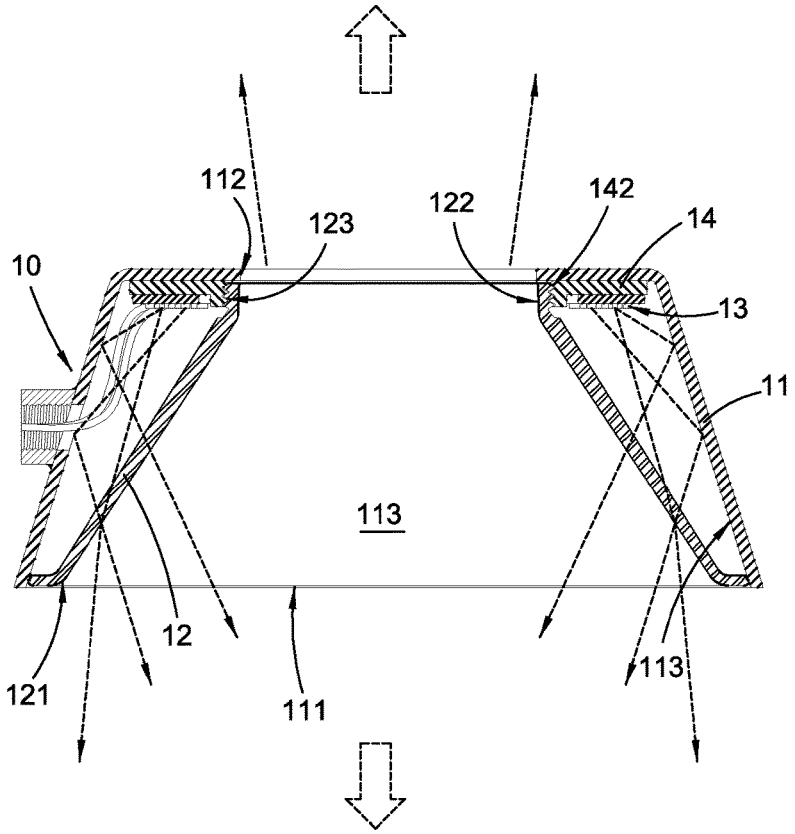
FIG. 2 is a cross sectional view showing the assembly of a part of the lamp structure according to the first embodiment of the present invention.

The lampshade 11 is tubular and includes a first light exit 111 and a second light exit 112 which are defined on two ends of the lampshade 11 respectively (as shown in FIG. 2), the lampshade 11 is opaque and is made of aluminum or aluminum alloy so as to dissipate heat quickly. The lampshade 11 further includes a reflective face 113 formed on an inner wall thereof, wherein the reflective face 113 is made of metal or is a plating layer. The lampshade 11 is conically tubular, wherein the first light exit 111 is defined on a first end of the lampshade 11, and the second light exit 112 is defined on a second end of the lampshade 11, wherein a diameter of the first light exit 111 is more than the second light exit 112.

The light transmission cover 12 is tubular and is accommodated in the lampshade 11, a gap is defined between the light transmission cover 12 and the reflective face 113, and the light transmission cover 12 is transparent or is matte. The light transmission cover 12 is made of any one of matte glass, acrylic, and plastic. The light transmission cover 12 is conically tubular and includes a first opening 121 and a second opening 122 which are formed on two ends of the light transmission cover 12 respectively, and a diameter of the first opening 121 is more than the second opening 122, the first opening 121 is close to the first light exit 111 of the lampshade 11.

The light emitting element 13 is housed in the lampshades 11 and is defined between the light transmission cover 12 and the reflective face 113, the light emitting element 13 is any one of an annular light-emitting diode (LED) plate, a ring comprised of multiple annular light-emitting diodes (LED), and an annular fluorescent tube.

The lamp head 10 includes a connection sheet 14 fixed in the lampshade 11 with the light emitting element 13 by using multiple screw bolts 141 and located proximate to the second light exit 112, wherein the light emitting element 13 is located below the connection sheet 14 between the inner wall of the lampshade 11 and the light emitting element 13, the connection sheet 14 has a circular opening 142, the light transmission cover 12 has a threaded section 123 arranged on an outer rim of an upper end thereof so as to screw with the circular opening 142 of the connection sheet 14.

Some of lights of the light emitting element 13 penetrate through the light transmission cover 12, another of the lights of the light emitting element 13 reflect from the reflective face 113 of the lampshade 11 to illuminate out the lamp head 10 via a front side of the light transmission cover 12 and the first light exit 111, and the other lights of the light emitting element 13 emit to a rear side of the lampshade 10.

Figure 6:
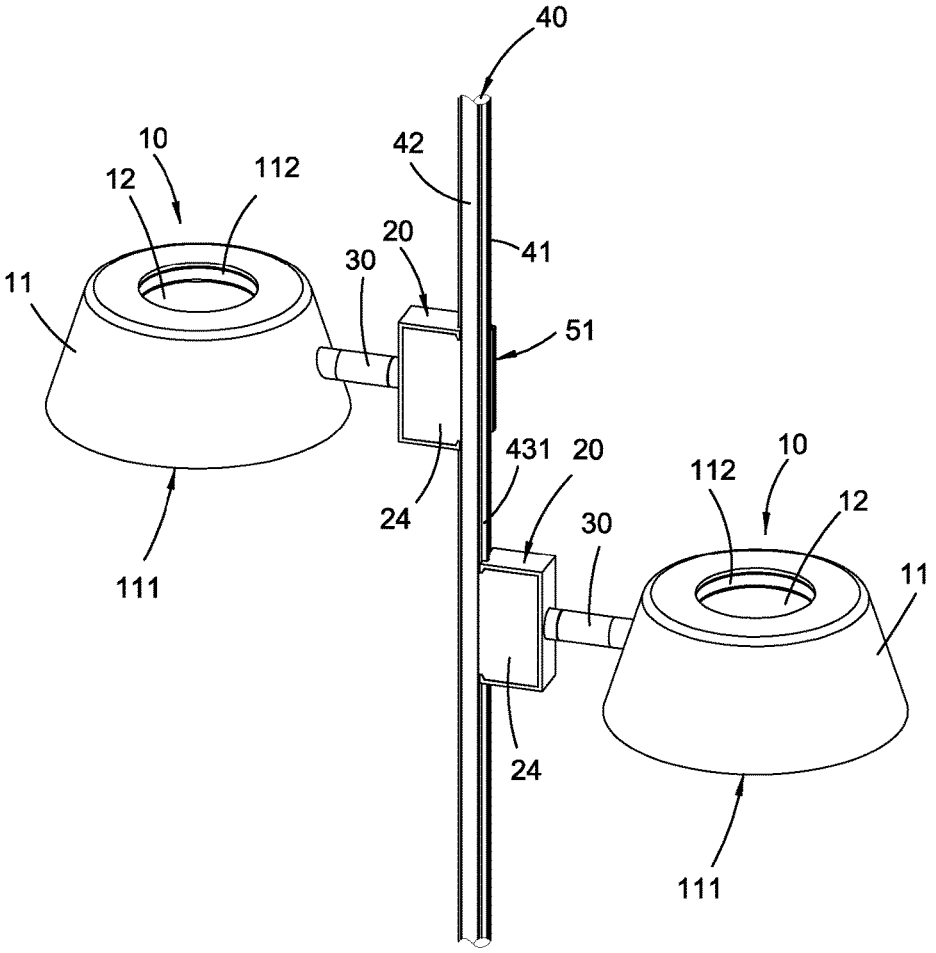
FIG. 6 is a perspective view showing the application of the lamp structure according to the third embodiment of the present invention.
Figure 10:
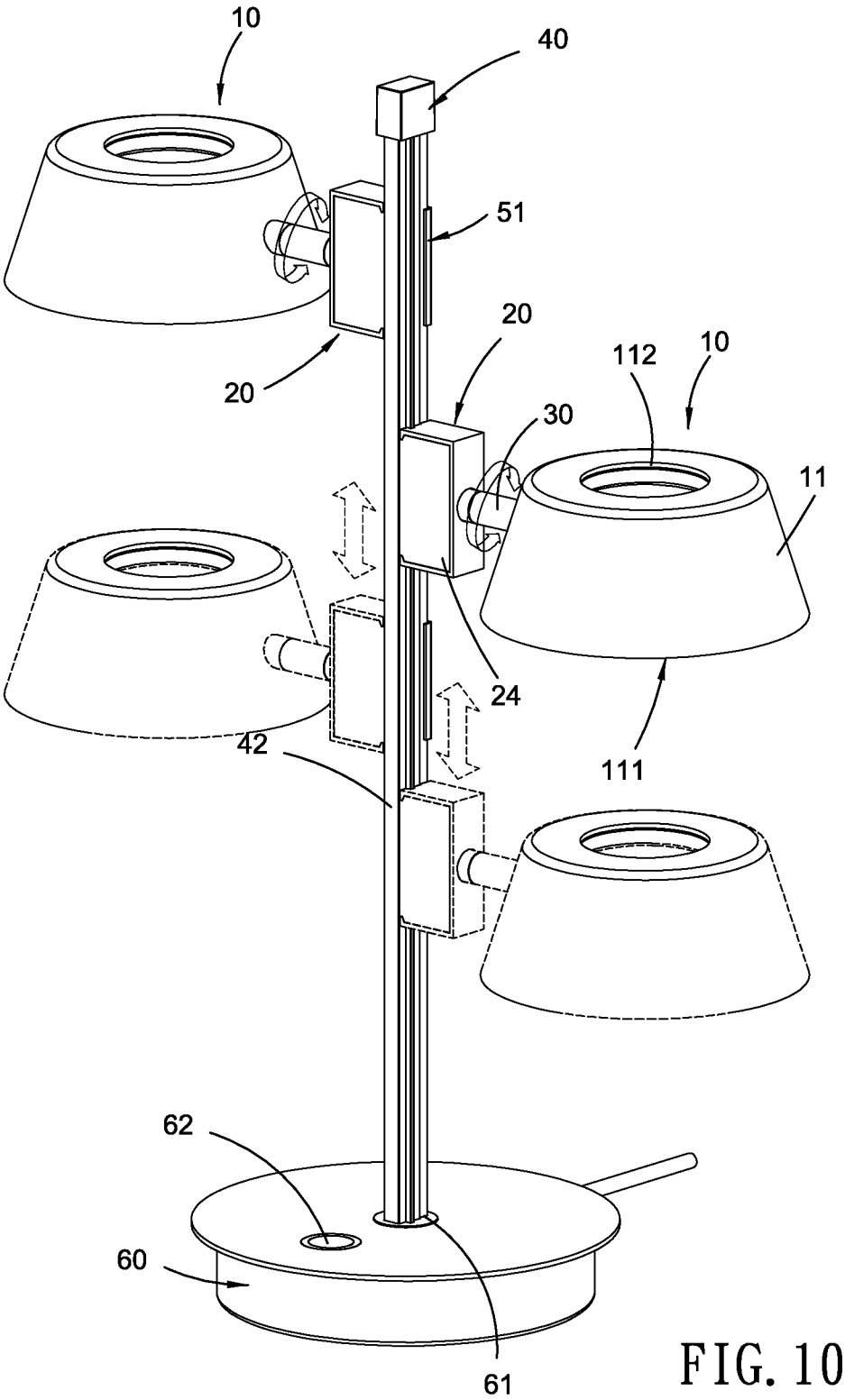
FIG. 10 is a perspective view showing the application of the lamp structure according to the fourth embodiment of the present invention.

Referring to FIGS. 6 and 10, the lampshade 10 produces backlights on a rear end thereof so as to obtain decorative atmosphere.

The magnetic seat 20 includes a holding member 21, at least one magnet 22 accommodated in the holding member 21, a first electrode plate 23, and a second electrode plate 24. The first electrode plate 23 and the second electrode plate 24 are electrically connected with the light emitting element 13 via a wire 25, wherein the first and second electrode plates 23, 24 are made of metal material consisting of iron, the magnet 22 magnetically attracts and produces magnetic force on the first and second electrode plates 23, 24, wherein the magnet 22 is a rare-earth magnet, and the first and second electrode plates 23, 24 magnetically attract on a conductive component consisting of iron by using the magnetic force so as to form a power circuit. The magnetic seat 20 includes two magnets 22 magnetically attracting on the first and second electrode plates 23, 24 respectively so as to produce the magnetic force on the first and second electrode plates 23, 24.

Figure 3:
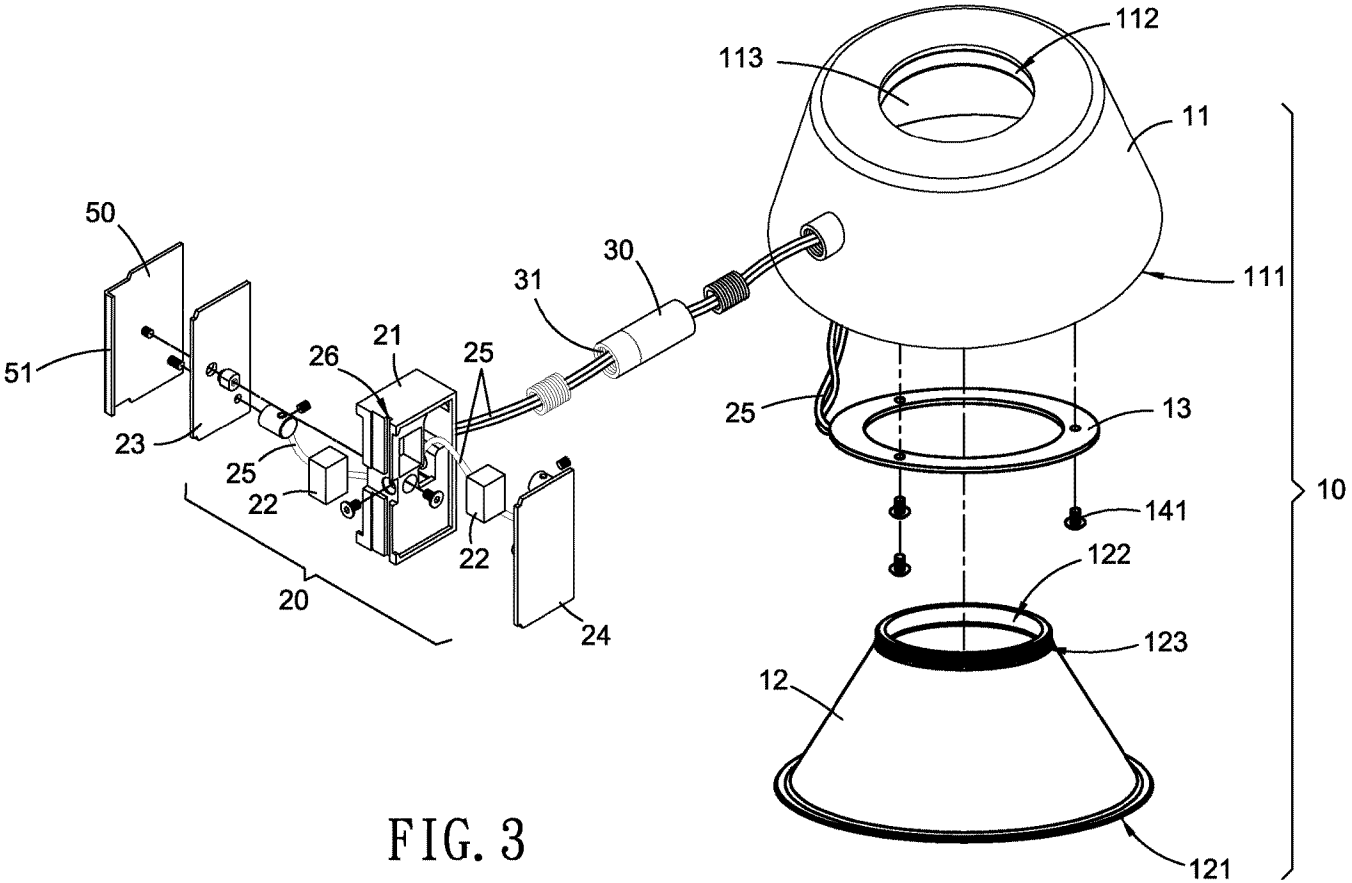
FIG. 3 is a perspective view showing the exploded components of a lamp structure according to a second embodiment of the present invention.

Referring to FIG. 3, in a second embodiment, the lamp structure further comprises a universal shaft 30, two ends of which are rotatably connected with the lampshade 11 of the lamp head 10 and the holding member 21 of the magnetic seat 20 individually so that the lamp head 10 is capable of being adjustably rotated to any direction by ways of the universal shaft 30 (as shown in FIG. 10). Preferably, the two ends of the universal shaft 30 are rotatably connected with the lampshade 11 of the lamp head 10 and the holding member 21 of the magnetic seat 20 individually by using a ball joint. Alternatively, the universal shaft 30 includes a passage 31 defined therein so as to accommodate the wire 25 which is electrically connected with the light emitting element 13, the first electrode plate 23, and the second electrode plate 24.

Figure 4:
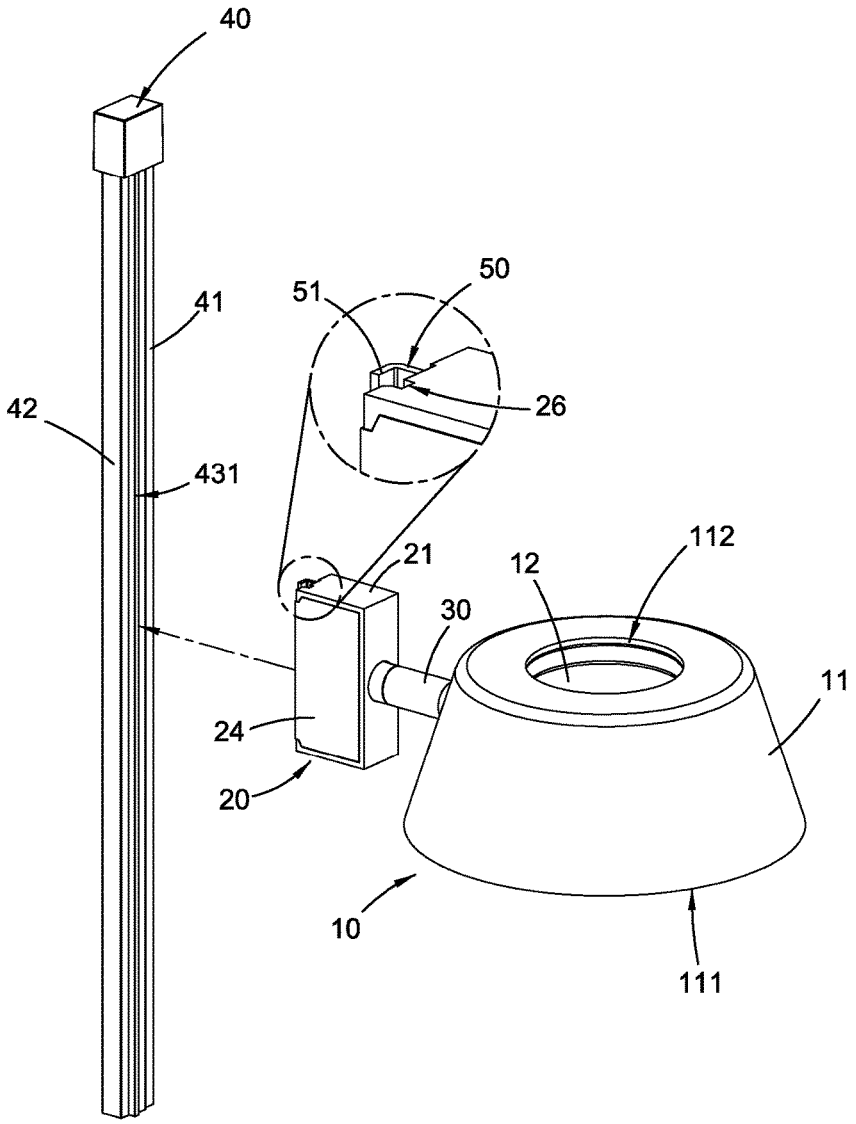
FIG. 4 is a perspective view showing the exploded components of a lamp structure according to a third embodiment of the present invention.
Figure 5:
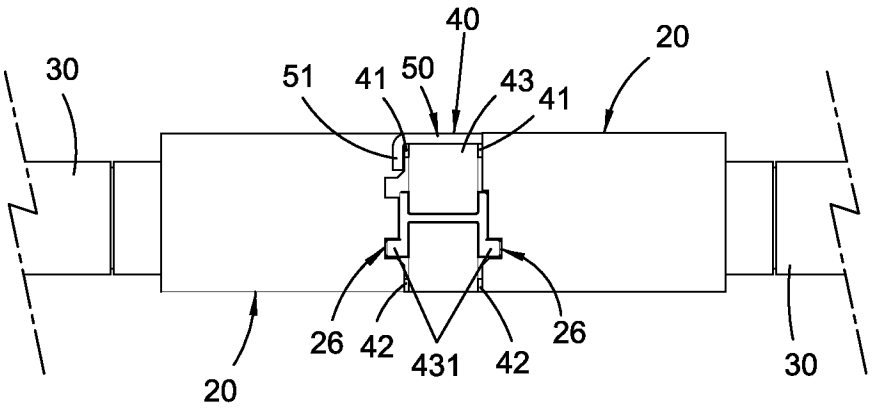
FIG. 5 is a cross sectional view showing the assembly of a part of the lamp structure according to the third embodiment of the present invention.

As shown in FIG. 4, in a third embodiment, the lamp structure further comprises a track 40 including a body 43, a first conductive rail 41 and a second conductive rail 42 which are both electrically connected with a power source, wherein the first and second conductive rails 41, 42 are made of metal material consisting of iron so as to transmit power, and the body 43 is made of electrical insulation material (such as plastic). The first and second conductive rails 41, 42 are separated by the body 43 so as to avoid short circuit. For example, the body 43 is defined between the first and second conductive rails 41, 42, and two peripheral sides of each of the first and second conductive rails 41, 42 extend out of the body 40 (as illustrated in FIG. 5), the first and second electrode plates 23, 24 magnetically attract on the first and second conductive rails 41, 42 respectively so as to produce a power circuit. Two lamp heads 10 magnetically attract on the first and second conductive rails 41, 42 by ways of the magnetic seat 20, are electrically connected with the power source, and move along the track 40 (as shown in FIG. 10).

The magnetic seat 20 includes a fixing piece 50 mounted thereon, wherein the fixing piece 50 has a hook 51 extending outward from a peripheral side thereof and hooking with a peripheral side of the track 40. The fixing piece 50 is adhered on a side of the first electrode plate 23 and is magnetically attracted by the at least one magnet 22. After the first electrode plate 23 magnetically attracts on a first peripheral side of the first conductive rail 41 by using the magnetic force, the hook 51 of the fixing piece 50 hooks on a second peripheral side of the first conductive rail 41, and the fixing piece 50 magnetically attracts the first 41 (as shown in FIG. 8).

With reference to FIG. 5, the first and second conductive rails 41, 42 are arranged on two peripheral sides of the body 43, and the two peripheral sides of each of the first and second conductive rails 41, 42 extend out of two peripheral sides of the body 43 to contact with the first and second electrode plates 23, 24 respectively so as to produce the power circuit. In this embedment, the two lamp heads 10 are mounted on the two peripheral sides of the track 40.

Figure 8:
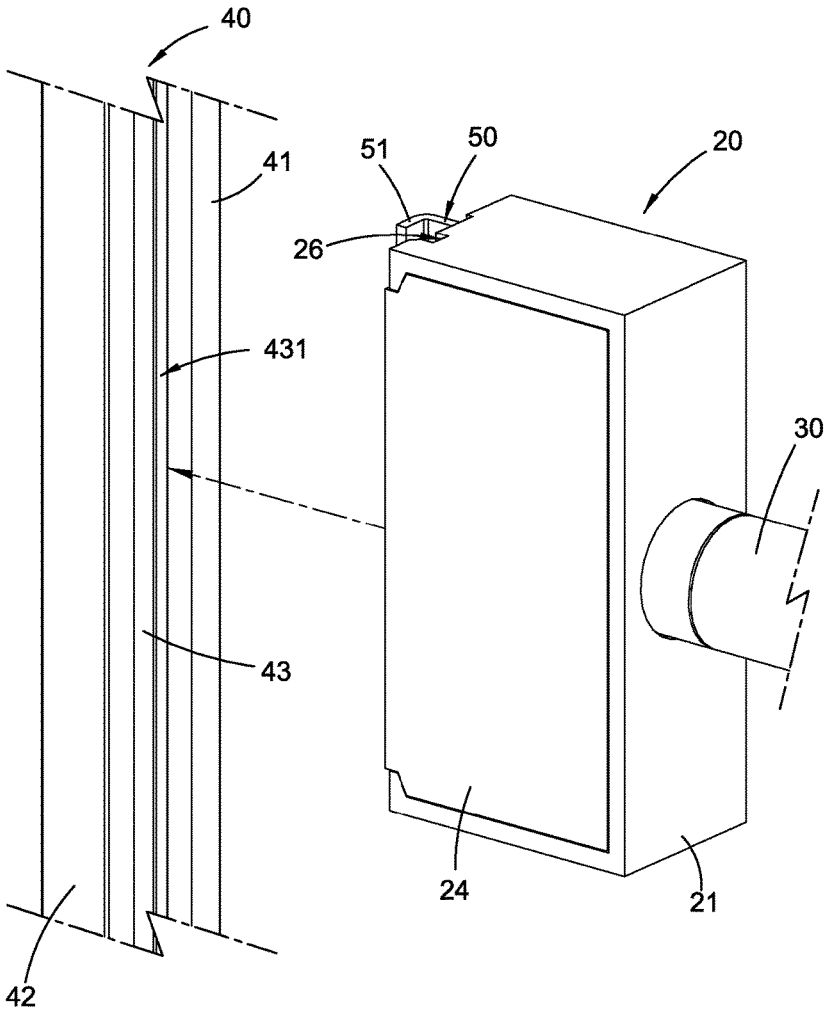
FIG. 8 is a perspective view showing the exploded components of a part of the lamp structure according to the fourth embodiment of the present invention.
Figure 9:
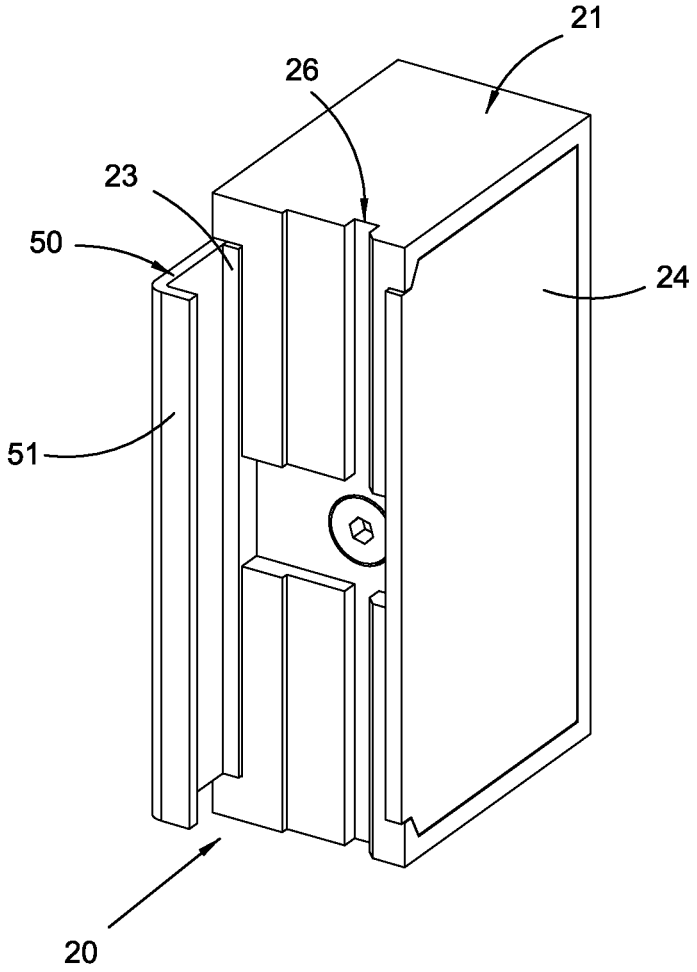
FIG. 9 is a perspective view showing the assembly of a part of the lamp structure according to the fourth embodiment of the present invention.

Referring to FIGS. 8 and 10, in the third embodiment, the lamp structure further comprises a defensive structure so as to avoid magnetically attracting the first and second electrode plates 23, 24 on the first and second conductive rails 41, 42 wrongly.

The defensive structure includes a guide rail 431 arranged on the body 43 and includes a recess 26 defined in the holding member 21 of the magnetic seat 20. The guide rail 431 is a protrusion extending along the body 43 and deviates from a central axis of the body 43. For example, the guide rail 431 is close to a peripheral side of the body 43 proximate to the second conductive rail 42. Furthermore, the recess 26 is engaged with the guide rail 431.

When the first and second electrode plates 23, 24 magnetically attract on the first and second conductive rails 41, 42 correctly, the recess 26 is engaged with the guide rail 431. When the recess 26 cannot be engaged with the guide rail 431, the first and second electrode plates 23, 24 magnetically attract on the first and second conductive rails 41, 42 incorrectly.

Figure 7:
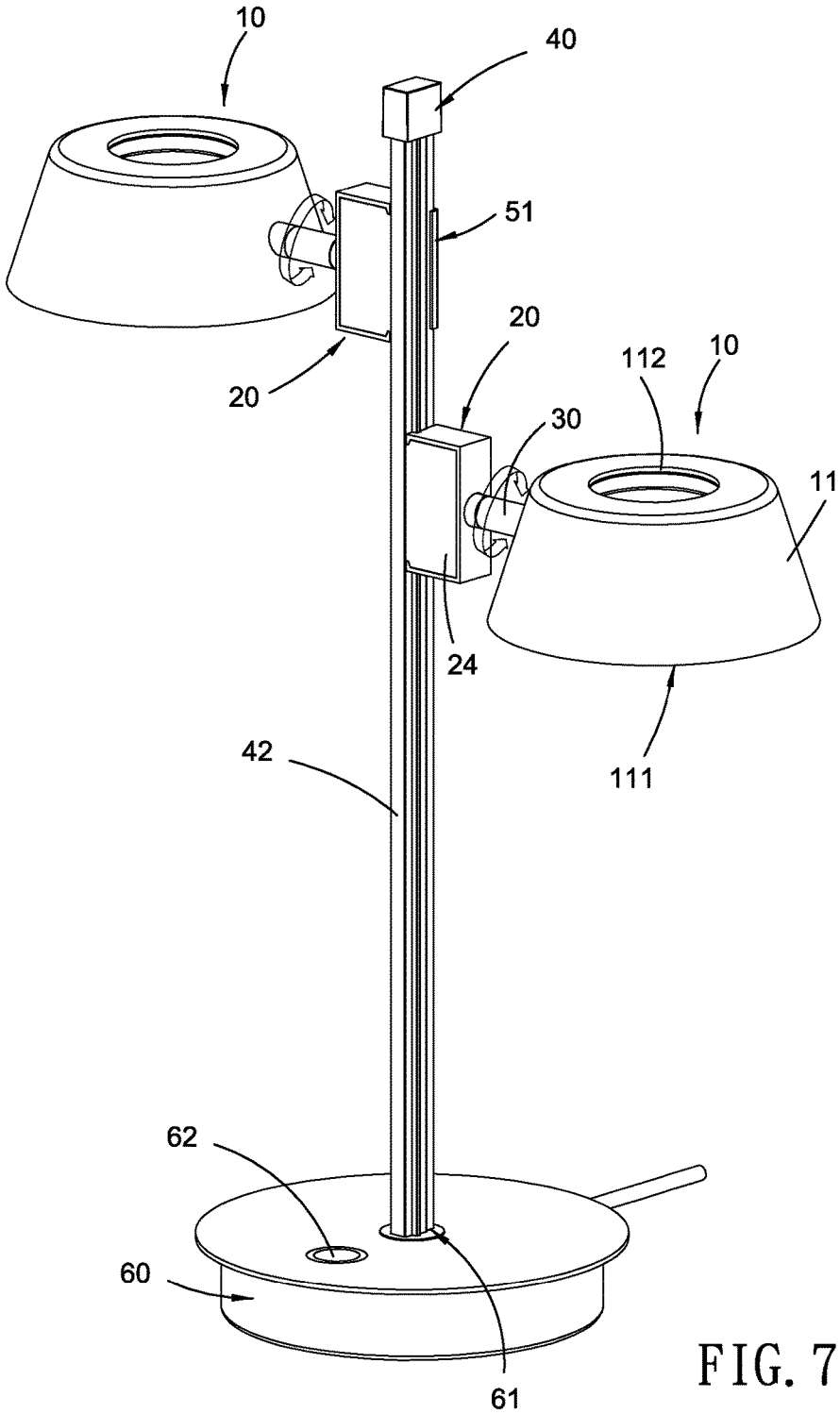
FIG. 7 is a perspective view showing the assembly of a lamp structure according to a fourth embodiment of the present invention.

Referring to FIG. 7, in a fourth embodiment, the lamp structure further comprises a base 60 configured to erect a table lamp or a floor lamp having at least one lamp head on a table or a ground. The base 60 includes a counterweight member (such as an iron block) accommodated therein, wherein the base 60 includes a receiving orifice 61 into which the track 40 is inserted, and the base 60 includes a power switch 62 fixed thereon and electrically connected with the power source so as to turn on/off the at least one lamp head 10. Thereby, multiple lamp heads 10 are arranged on the track 40 so as to be applicable for the table lamp or the floor lamp. Preferably, the track 40 is vertically erected on the base 60 and multiple lamp heads 10 are symmetrically arranged on a central position of the track 40.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A lamp structure comprising:

a lamp head including a lampshade, a light transmission cover, and a light emitting element;

a magnetic seat including a holding member, at least one magnet accommodated in the holding member, a first electrode plate, and a second electrode plate;

wherein the lampshade is tubular and includes a first light exit and a second light exit which are defined on two ends of the lampshade respectively, and the lampshade is opaque and includes a reflective face formed on an inner wall thereof;

wherein the light transmission cover is tubular and is accommodated in the lampshade, and a gap is defined between the light transmission cover and the reflective face;

wherein the light emitting element is housed in the lampshades and is defined between the light transmission cover and the reflective face, some of lights of the light emitting element penetrate through the light transmission cover, another of the lights of the light emitting element reflect from the reflective face of the lampshade to illuminate out the lamp head via a front side of the light transmission cover and the first light exit, and the other lights of the light emitting element emit to a rear side of the lampshade;

wherein the first electrode plate and the second electrode plate are electrically connected with the light emitting element via a wire, and the first and second electrode plates are made of metal material consisting of iron, the magnet magnetically attracts and produces magnetic force on the first and second electrode plates, wherein and the first and second electrode plates magnetically attract on a conductive component consisting of iron by using the magnetic force so as to form a power circuit.

2. The lamp structure as claimed in claim 1, wherein the lampshade is conically tubular, wherein the first light exit is defined on a first end of the lampshade, and the second light exit is defined on a second end of the lampshade, wherein a diameter of the first light exit is more than the second light exit; the light transmission cover is conically tubular and includes a first opening and a second opening which are formed on two ends of the light transmission cover respectively, and a diameter of the first opening is more than the second opening, the first opening is close to the first light exit of the lampshade.

3. The lamp structure as claimed in claim 1, wherein the light transmission cover is made of any one of matte glass, acrylic, and plastic.

4. The lamp structure as claimed in claim 1, wherein the light emitting element is any one of an annular light-emitting diode (LED) plate, a ring comprised of multiple annular light-emitting diodes (LED), and an annular fluorescent tube.

5. The lamp structure as claimed in claim 1 further comprising a universal shaft, two ends of which are rotatably connected with the lampshade of the lamp head and the holding member of the magnetic seat individually.

6. The lamp structure as claimed in claim 5, wherein the two ends of the universal shaft are rotatably connected with the lampshade of the lamp head and the holding member of the magnetic seat individually by using a ball joint.

7. The lamp structure as claimed in claim 5, wherein the universal shaft includes a passage defined therein so as to accommodate the wire which is electrically connected with the light emitting element, the first electrode plate, and the second electrode plate.

8. The lamp structure as claimed in claim 5 further comprising a track including a body, a first conductive rail and a second conductive rail which are both electrically connected with a power source, wherein the first and second conductive rails are made of metal material consisting of iron so as to transmit power, and the body is made of electrical insulation material, wherein the first and second conductive rails are separated by the body, and the first and second electrode plates magnetically attract on the first and second conductive rails respectively so as to produce a power circuit.

9. The lamp structure as claimed in claim 8, wherein the first and second conductive rails are arranged on two peripheral sides of the body, and the two peripheral sides of each of the first and second conductive rails extend out of two peripheral sides of the body to contact with the first and second electrode plates respectively so as to produce the power circuit.

10. The lamp structure as claimed in claim 8 further comprising:

a guide rail arranged on the body; and a recess defined in the holding member of the magnetic seat;

wherein the guide rail is a protrusion extending along the body and deviates from a central axis of the body;

wherein when the first and second electrode plates magnetically attract on the first and second conductive rails correctly, the recess is engaged with the guide rail.

* * * * *